United States Patent [19]

Mills

[11] 4,257,473

[45] Mar. 24, 1981

[54] CONTINUOUS CASTING SHROUD APPARATUS AND METHOD

[75] Inventor: Norman T. Mills, Highland, Ind.

[73] Assignee: Inland Steel Company, Chicago, Ill.

[21] Appl. No.: 947,652

[22] Filed: Oct. 2, 1978

[51] Int. Cl.[3] ..... B22D 11/10

[52] U.S. Cl. ..... 164/82; 164/437

[58] Field of Search ..... 164/437, 82

[56] References Cited

U.S. PATENT DOCUMENTS 3,800,853 4/1974 Neumann et al. ..... 164/437

FOREIGN PATENT DOCUMENTS 48-47760 4/1973 Japan .
50-152004 12/1975 Japan .

OTHER PUBLICATIONS

Silicon Nitride in the Foundry, Flye, D. J., *Metals and Materials,* Jul./Aug. 1977, pp. 36–37.

*Primary Examiner*—Robert D. Baldwin
*Attorney, Agent, or Firm*—Merriam, Marshall & Bicknell

[57] ABSTRACT

A shroud apparatus for the continuous casting of steel comprising a fused silica or like refractory oxide nozzle having the outer surface thereof which is normally contacted by the layer of fused slag on the surface of the molten metal in the continuous casting mold when the nozzle is into normal operating position enclosed by a ring or sleeve formed of a slag resistant material, such as silicon nitride, boron nitride or zirconium diboride. In one embodiment the nozzle has a ring member slidable axially along the length thereof with the ring floating in the molten metal and having one end immersed in the molten metal and the other end extending above the slag layer. In another embodiment the nozzle has a protective ring member formed of the slag-resistant material mounted fixedly on the outer surface of the nozzle with the ring being of such length and positioned axially on the nozzle so that only the protective ring will be contacted by the slag layer during the continuous casting operation. The method of continuous casting using such a shroud apparatus greatly increases the continuity and efficacy of the continuous casting operation and improves the quality of the continuous casting.

12 Claims, 7 Drawing Figures

FIG. 1
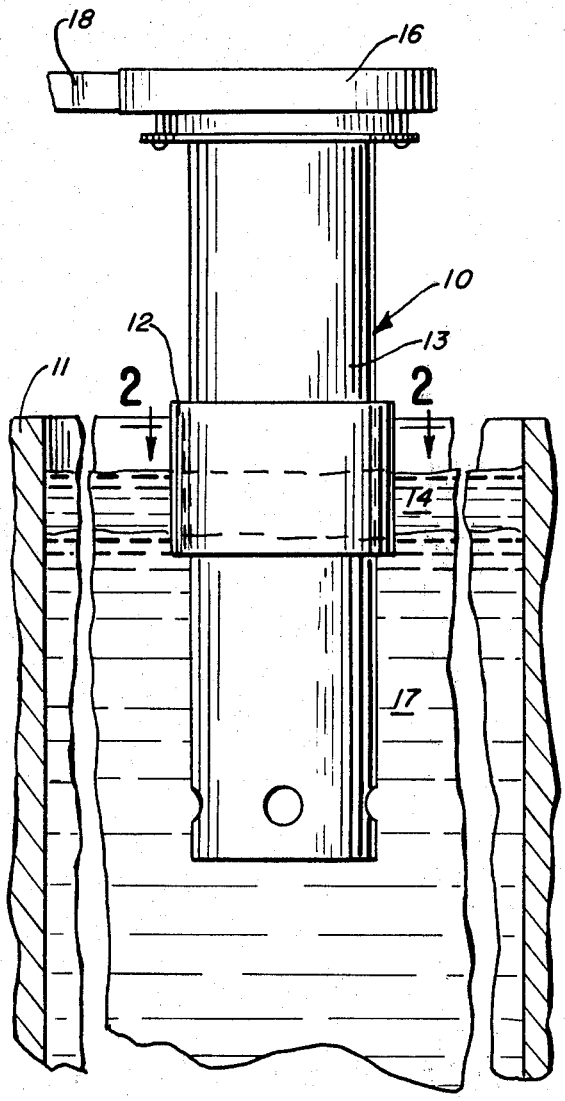
FIG. 3
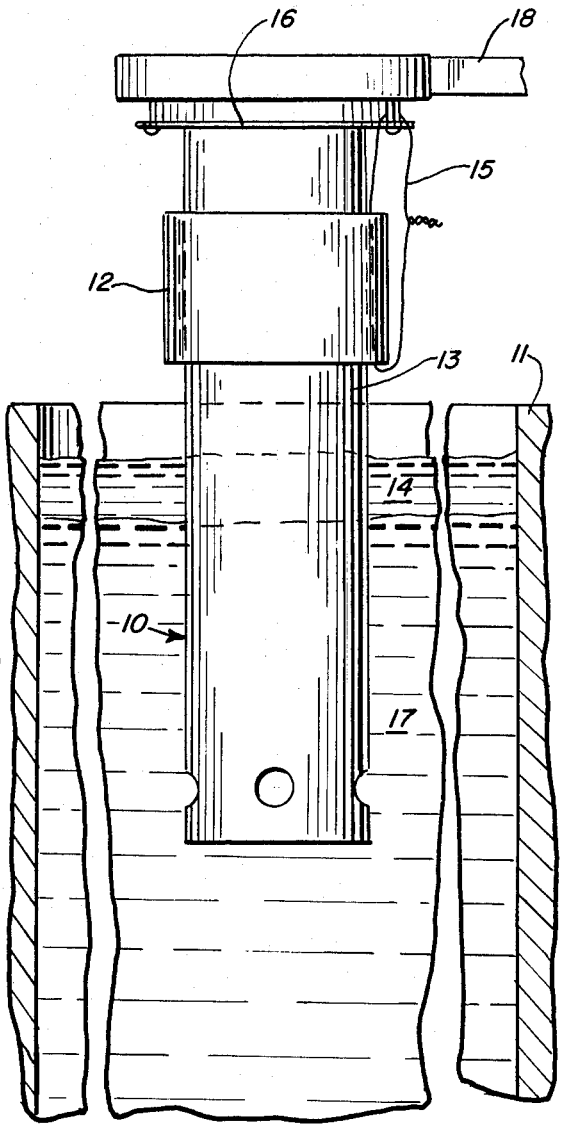
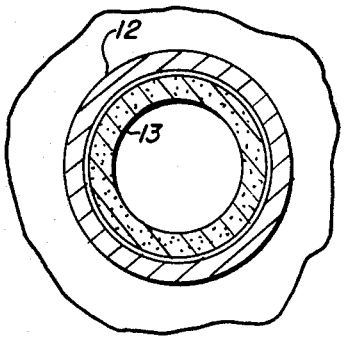
FIG. 2

FIG. 4
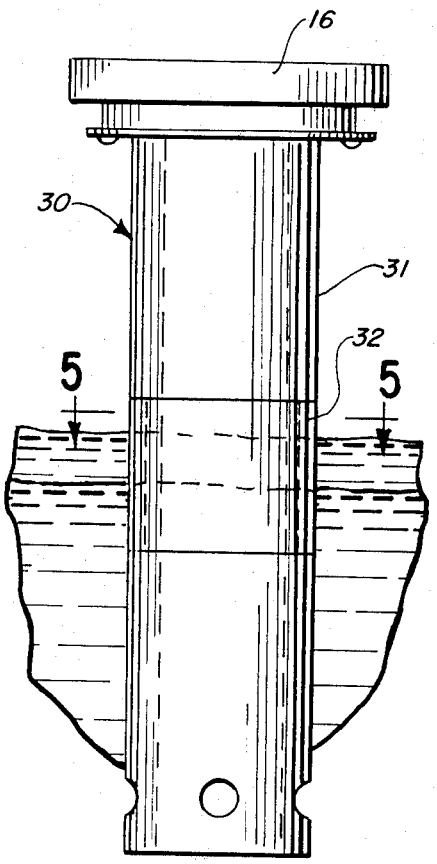
FIG. 6
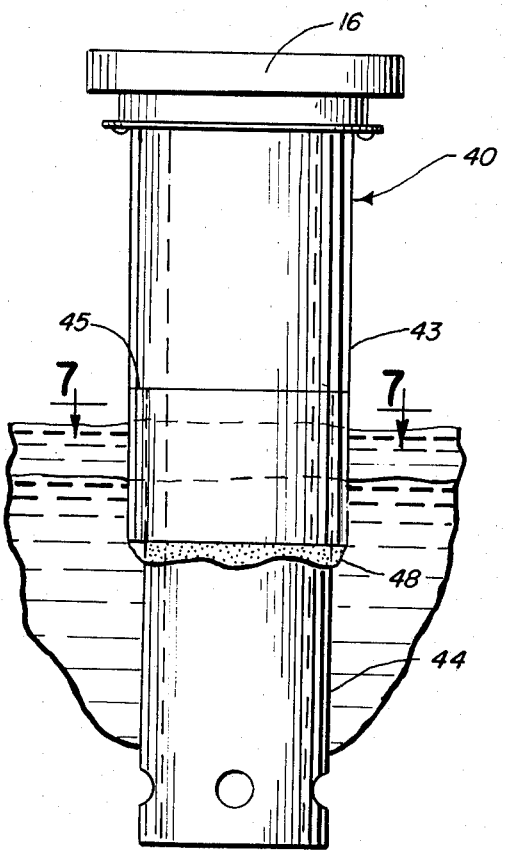
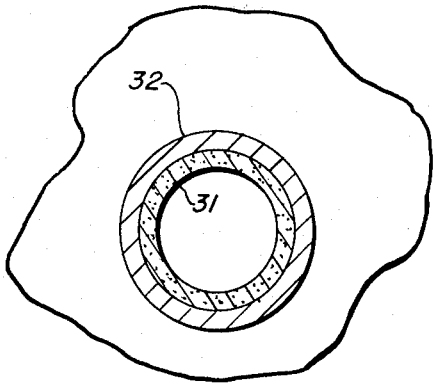
FIG. 5
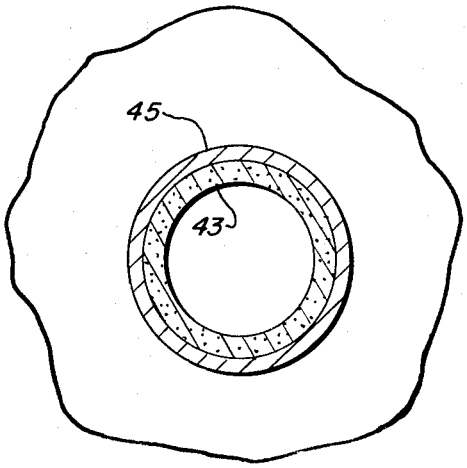
FIG. 7

CONTINUOUS CASTING SHROUD APPARATUS AND METHOD

The present invention relates generally to an apparatus for the continuous casting of steel and more particularly to an improved shroud apparatus and method for introducing molten steel into a continuous casting mold.

In the continuous casting of steel, it has been found that improved casting results can be achieved by introducing the molten steel below the surface of the pool of molten steel maintained in the upper end of the continuous casting mold. Various tubular devices have been designed for conveying and discharging molten steel into a continuous casting mold, such as the improved casting shroud or nozzle structures of the type disclosed in the Mills et al U.S. Pat. No. 3,578,064. Most of the shrouds or feed nozzles used for conducting molten steel below the surface of the pool of molten steel in a continuous casting mold are made of a refractory oxide, such as fused silica, because of the high temperature resistance thereof and relatively low cost.

It has also been found that further improvements in continuous casting results are obtained by providing on the surface of the pool of molten steel maintained in the upper end of the continuous casting mold a protective layer of molten slag. It is important that the molten slag layer, in addition to reducing heat losses and preventing oxidation at the surface of the molten steel, also readily dissolve refractory oxides, such as alumina, which are rejected by the molten metal and form a scum on the surface of the pool of molten steel in the mold, particularly when casting an aluminum killed steel. Many different slag compositions have been used to form the molten slag layer, including borax, sodium silicate, blast furnace slag, window glass, bottle glass and improved synthetic slag compositions. An example of an improved continuous casting synthetic slag composition which readily dissolves alumina is disclosed in the Halley et al U.S. Pat. No. 3,649,249.

Many of the molten continuous casting slag compositions which have a high solubility for alumina also rapidly attack feed nozzles formed of a refractory oxide, such as fused silica. In many cases the lateral wall of a silica feed nozzle in contact with such a molten slag is eaten away and can be completely dissolved at the slag line within the continuous casting mold after only 80 minutes of the continuous casting operation with the result that the quality of the remainder of the continuous casting is poor. In order to maintain the quality of the continuous casting, the feed nozzle is normally replaced before the nozzle wall is completely dissolved by the slag in the mold. This requires installation of costly and complex apparatus and making frequent nozzle changes which further increases production costs, because of production delays and the temporary decrease in casting quality which occurs while a nozzle change is being made. And, each time the continuous casting machine is stopped to make a nozzle change, the danger of an accident occurring is greatly increased. Thus, it is highly desirable to reduce the frequency of making nozzle changes during the continuous casting of steel.

It is, therefore, an object of the present invention to provide apparatus for the continuous casting of steel which is resistant to attack by molten slags having a high solubility for refractory oxides.

It is a further object of the present invention to provide a fused silica feed nozzle or shroud for conveying molten metal below the surface of the pool of molten metal maintained in the upper end of a continuous casting mold which is highly resistant to attack by a molten continuous casting slag layer having a high solubility for silica.

It is still another object of the present invention to provide an improved method of continuous casting an aluminum killed steel using a refractory metal oxide supply device or shroud formed mainly of silica which is resistant to attack by a molten continuous casting slag layer having a high solubility for silica.

Other objects of the present invention will be apparent from the detailed description and claims to follow when read in conjunction with the accompanying drawing wherein:

FIG. 1 is a schematic side elevational view of apparatus comprising a continuous casting feed nozzle or shroud for conveying molten steel from a supply source into a continuous casting mold showing one embodiment of the present invention with the elements thereof in operative position within a continuous casting mold.

FIG. 2 is a horizontal sectional view taken along the line 2—2 of FIG. 1;

FIG. 3 is a schematic side elevational view of a continuous casting apparatus comprising a feed nozzle or shroud of FIG. 1 in one stage of assembling into an operative position within the mold;

FIG. 4 is a schematic side elevational view of a continuous casting shroud apparatus embodying a modified form of the present invention;

FIG. 5 is a horizontal sectional view taken along the line 5—5 of FIG. 4;

FIG. 6 is a schematic side elevational view of a continuous casting shroud apparatus embodying a still further modified form of the present invention; and FIG. 7 is a horizontal sectional view taken along the line 7—7 of FIG. 6.

It has been found that when a shroud or feed nozzle made of a refractory oxide, such as fused silica, used for conducting molten metal into a continuous casting mold below the surface of the pool of molten metal having a protective layer of molten slag on the surface thereof when provided as described herein with a protective outer tubular section, such as a collar or ring member, comprised of a refractory material which is resistant to attack by the layer of molten slag and which is preferably formed of silicon nitride ($Si_3N_4$) or a silicon nitride bonded mixture of silicon nitride and a refractory filler material, such as silicon carbide, zirconium silicate, zirconia, alumina or silica, wherein the silicon nitride or like resistant refractory material is a major constituent, but not necessarily forming more than 50% by volume of the composition, the shroud or feed nozzle will have a high degree of resistance to attack by the layer of molten slag. The collar or ring member is positioned on the outer lateral surface of the tubular main body section of the feed nozzle so as to protectively enclose at least the surface area of the feed nozzle which comes in contact with the slag layer maintained in the mold when the nozzle is in an operative position within the mold during the continuous casting operation. Substantial amounts of one or more of the high melting point filler materials, such as silicates or oxides, can be present in the collar or ring with the silicon nitride or like resistant refractory material without significantly reducing the resistance of the shroud or feed nozzle of the present invention to attack by the molten slag composition.

In the embodiment of the present invention in FIGS. 1 and 2, a continuous casting shroud or feed nozzle 10 formed of fused silica or a similar refractory oxide is shown in operative position within a continuous casting mold 11 with a generally cylindrical sleeve or collar 12 preferably of silicon nitride base material mounted for slidably axial movement along the generally cylindrical tubular main body section 13 of the feed nozzle 10. The silicon nitride collar 12 has an inner diameter only slightly larger than the outer diameter of the tubular main body section 13 so that no significant amount of the molten slag layer 14 can come into contact with the outer surface of the feed nozzle 10.

In FIG. 3 which illustrates one method of assembling the shroud apparatus of FIG. 1 the collar 12 is shown suspended above the pool of molten steel 17 and slag layer 14 by a length of high temperature resistant wire 15 from a shroud or metal bracket 16 secured to the lower wall 18 of a tundish prior to allowing the collar 12 to move downwardly into operative position, as shown in FIG. 1. As soon as the pool of molten steel 17 and the molten slag layer 14 on the surface of the molten steel have reached their normal operating levels, the wire 15 is cut and the collar 12 slides downwardly along the tubular main body section 13 until the collar 12 is supported by the molten steel in the pool of molten steel 17 with the lower portion of the collar 12 immersed in the molten steel 17 and the upper portion of the collar 12 extending above the surface of the molten slag layer 14. The molten slag layer 14 contacts only the outer-surface of the collar 12 between the ends thereof. And, when the level of molten steel 17 rises or falls within the mold 11, the collar 12 moves axially along the outer surface of the main body section 13 of the feed nozzle 10 as the level of the molten steel 17 in the mold rises and falls so that only the outer surface of the tubular main body section 13 of the feed nozzle 10 comes in contact with the molten metal slag layer 14.

In one method of making a protective collar 12 of FIGS. 1–3, elemental silicon, with or without a refractory filler material, in a finely divided form (i.e. below about 200 U.S. Std. mesh size and preferably −325 mesh) is roll blended with up to about 10% water (and preferably about 5%) to provide molding consistency and the blend screened through a 6-mesh screen to break up any large agglomerates. The screened mixture is molded into the form of the sleeve or collar 12 by isostatically pressing at a pressure of about 138 MPa (20,000 psi) and dried.

A collar formed entirely of silicon nitride was formed in the foregoing manner having dimensions of: 203 mm. (1 in.) length, 152 mm. (6 in.) O.D., 146 mm. (5¾ in.) I.D. Approximately 25 mm. (1 in.) was preferably cut off each end to form a sleeve 152 mm. (6 in.) long. The collar was then placed in a furnace and a continuous stream of nitrogen was passed through the furnace to transform the metallic silicon particles into a silicon nitride bonded body. The temperature in the furnace preferably was raised slowly as the nitrogen was passed therethrough reaching a maximum temperature of 1400° C. (2550° F.) after 74 hours and the furnace was held at maximum temperature for two hours, after which the collar consisting of silicon nitride was slowly cooled to room temperature.

When the resulting collar 12 was positioned, as in FIG. 1, on a fused silica feed nozzle within a continuous casting mold having a molten slag layer of the type disclosed in U.S. Pat. No. 3,649,249 the silica feed nozzle outer surface showed almost no evidence of being eroded by the molten slag layer at the slag line after about two hours of continuous casting of an aluminum killed steel. The results of the tests with the foregoing collar showed that the erosion rate of a fused silica nozzle is reduced to the point where the life of the nozzle or shroud is extended at least three to four times longer than would be expected when continuously casting steel with a fused silica nozzle without the collar 12.

Comparable improved results were obtained when a collar was prepared in a like manner containing on a volume basis 50 volume percent silicon nitride and 50 volume percent silicon carbide from a premix formed of 37.5 wt. percent metallic silicon having a particle size of about −325 mesh and 62.5 wt. percent silicon carbide having a particle size of about −100 mesh. A collar having a final composition of 50 volume percent silicon nitride and 50 volume percent zirconium silicate was formed from a premix containing 29.5 wt. percent metallic silicon having a particle size of about −325 mesh and 70.5 wt. percent zirconium silicate having a particle size of about −60 mesh.

FIGS. 4 and 5 show an apparatus embodying a modified form of the present invention which comprises a shroud or feed nozzle holder 16 with a shroud or feed nozzle 30 formed of fused silica or like refractory oxide material having a tubular main body section 31 and an outer tubular section or ring member 32 formed of a silicon nitride based refractory material fixedly secured to the outer surface of the main body section 31 by means of sintering the refractory oxide material forming the main body section 31 or by a refractory cement. The ring member 32 extends over the outer surface of the tubular main body section 31 which is normally contacted by the layer of molten slag in the mold when the feed nozzle 30 is in normal operating position during the continuous casting operation. The ring member 32 preferably has an outer diameter equal to that of the main body section 31 and is secured to the main body section 31 preferably in a recess formed in the outer surface of the main body section 31 with the recess having the same dimensions as the ring member 32.

In manufacturing the nozzle 30 having the ring member 32 fixedly secured thereto, the ring member 32 is first made in the manner described for producing the collar 12 of FIG. 1. The completed ring member 32 is then suspended in a mold having the desired shape of the nozzle 30 and finely divided fused silica slip is poured into the mold containing the ring member 32. The combined body is then removed from the mold and fired by heating to a temperature sufficient to bond the finely divided silica particles to each other without affecting the silicon nitride based refractory material forming the ring member 32 and at a temperature below the devitrification temperature of the silica (about 2550° F. or 1400° C.).

FIGS. 6 and 7 show a further modified form of the present invention which comprises a shroud or feed nozzle holder 16 with a shroud or feed nozzle 40 having a tubular main body section 42 having a uniform axial passage extending therethrough. The nozzle 40 can be formed of fused silica or like refractory material in a conventional manner. The main body section 42 is formed of an upper section 43 and the lower section 44. The lower section 44 has a uniform outer diameter which is smaller than the outer diameter of the upper section 43 so that a shoulder 45 is formed on the outer surface of the main body section 42 intermediate the ends thereof. A ring member 46 formed of a silicon nitride refractory material in the same manner as collar 12 in FIGS. 1–3 is mounted on the lower section 44 with the upper end of the ring member 46 abutting the shoulder 45. The position of the shoulder 45 on the outer surface of the main body section 42 and the length of the ring member 46 is such that the molten slag layer will contact only the ring member 46 during a continuous casting operation when the nozzle 40 is in normal operating position. The ring member 46 has an outer diameter preferably the same as the outer diameter of the upper section 43 with an inner diameter only slightly larger than the outer diameter of the lower section 44 so that the ring member 46 is slidably movable into position over the lower section 44. The ring member 46 is secured to the nozzle by a suitable refractory cement, as at 48 in FIG. 6. The refractory cement 48 preferably fills the space between the lower end of the ring member 46 and the lower section 44 to prevent any slag entering the space between the ring member 46 and the lower section 44.

While the specific embodiments illustrating the present invention heretofore described have been formed of silicon nitride based refractory materials, it is also possible to form a shroud apparatus of the present invention which is resistant to attack by a molten slag layer using finely divided elemental boron in a like manner in place of silicon to form boron nitride as a protective collar, sleeve or coating on the surface of a fused silica shroud so that the molten slag layer does not contact the shroud during the continuous casting operation. It is also possible to form a protective collar, sleeve or coating on the surface of a fused silica nozzle from zirconium diboride by hot pressing, sintering or plasma spraying the zirconium diboride.

I claim:

1. A method of continuous casting steel including introducing molten steel from a supply source through a tubular feed nozzle which is formed of a refractory oxide material into a continuous casting mold having a pool of molten steel and a layer of molten slag which has a high solubility for said refractory oxide material maintained on the surface of the molten steel in the upper end of the mold which comprises; conducting molten steel from a supply source through a tubular feed nozzle formed of said refractory oxide material into a continuous casting mold with the lower end of said feed nozzle submerged below the surface of the pool of molten steel in the mold, and maintaining the outer surface of said feed nozzle which is normally in contact with said layer of molten slag during continuous casting enclosed within a protective tubular member having at least the outer surface formed of refractory material containing at least 50 percent by volume refractory material selected from the group consisting of silicon nitride, boron nitride and zirconium diboride with said selected refractory material bonded by the selected one of said groups of refractory material to form said tubular member.

2. A method as in claim 1, wherein said steel is an aluminum killed steel and said slag layer has a high solubility for refractory metal oxides, and said feed nozzle is formed essentially of fused silica.

3. A method as in claim 1, wherein said protective tubular member is formed essentially of one of said group of refractory materials.

4. A composite feed nozzle for continuous casting steel comprising a tubular main body section formed of a refractory oxide which is subject to erosion by a layer of molten slag maintained in a continuous casting mold during continuous casting, means associated with the outer surface of said main body section providing a protective tubular section thereon, said tubular section being adapted to protectively enclose at least the portion of the outer surface of said tubular main body section which is normally in contact with said layer of molten slag, and said tubular section having at least the outer surface thereof formed of refractory material comprised of at least 50% by volume of a refractory material selected from the group consisting of silicon nitride, boron nitride and zirconium diboride with said selected refractory material bonded by the selected one of said group of refractory material to form said tubular section.

5. A composite feed nozzle as in claim 4, wherein said protective tubular section is in the form of a ring member which is adapted to be fixedly secured to the outer surface of said tubular main body section and extends at least over the outer surface of the tubular main body section which is normally contacted by the layer of molten slag in the mold when the feed nozzle is in normal operating position during the continuous casting of steel.

6. A composite feed nozzle as in claim 5, wherein said ring member is fixedly secured to the said tubular main body section by sintered refractory oxide material forming said main body section.

7. A composite feed nozzle as in claim 5, wherein said tubular main body section has a reduced diameter section extending over said outer surface normally contacted by said layer of molten slag with the outer surface of said small diameter section engaging the inner surface of said ring member.

8. A composite feed nozzle as in claim 5, wherein said ring member is fixedly secured to the outer surface of said tubular main body section by means of a refractory cement.

9. A composite feed nozzle as in claim 5, wherein said main body section has an abutment shoulder formed on the outer surface between the ends thereof with said ring member having the upper end thereof in abutting engagement with said shoulder and the lower edge of said ring member secured to the main body section by means of a refractory cement.

10. A composite feed nozzle as in claim 5 through 9, wherein said ring member is comprised essentially of one of said group of refractory materials.

11. A composite feed nozzle as in claim 4, wherein said protective tubular section consists of a plasma sprayed coating of zirconium diboride on said portion of the main body section normally in contact with molten slag.

12. A composite feed nozzle as in claim 4, wherein the selected refractory material forming the protective tubular section is silicon nitride with the balance of said tubular section being silicon carbide, and said tubular main body section being formed of fused silica.

* * * * *